United States Patent [19]

Stubbins

[11] Patent Number: 4,974,438

[45] Date of Patent: Dec. 4, 1990

[54] ROLLING MILL HOUSING STRUCTURE

[75] Inventor: Derek Stubbins, Sheffield, England

[73] Assignee: Davy McKee (Sheffield) Limited, Yorkshire, England

[21] Appl. No.: 275,107

[22] PCT Filed: Mar. 18, 1988

[86] PCT No.: PCT/GB88/00209

§ 371 Date: Nov. 17, 1988

§ 102(e) Date: Nov. 17, 1988

[87] PCT Pub. No.: WO88/06930

PCT Pub. Date: Sep. 22, 1988

[30] Foreign Application Priority Data

Mar. 19, 1987 [GB] United Kingdom ..... 8706603

[51] Int. Cl.[5] ..... B21B 31/08

[52] U.S. Cl. ..... 72/238

[58] Field of Search ..... 72/238, 239, 225, 245

[56] References Cited

U.S. PATENT DOCUMENTS

| | | | |
|---|---|---|---|
| 1,628,175 | 5/1927 | Moller | 72/238 |
| 3,712,102 | 1/1973 | Eibe | 72/238 |
| 4,552,007 | 11/1985 | Mantovan | 72/239 |
| 4,753,097 | 6/1988 | Buchheit | 72/238 |

FOREIGN PATENT DOCUMENTS

| | | | |
|---|---|---|---|
| 19238 | 11/1980 | European Pat. Off. . | |
| 1937368 | 2/1971 | Fed. Rep. of Germany . | |
| 2263572 | 7/1974 | Fed. Rep. of Germany . | |
| 3421486 | 12/1984 | Fed. Rep. of Germany . | |
| 2541600 | 8/1984 | France . | |
| 139866 | 10/1979 | Japan . | |
| 156817 | 9/1982 | Japan | 72/238 |
| 114706 | 5/1987 | Japan . | |
| 2034222 | 6/1980 | United Kingdom . | |

*Primary Examiner*—Daniel C. Crane

*Attorney, Agent, or Firm*—Foley & Lardner, Schwartz, Jeffery, Schwaab, Mack, Blumenthal & Evans

[57] ABSTRACT

A housing structure for a rolling mill stand has two housings spaced apart and secured together with a spacer structure clamped between them by replaceable bolts. The housings support horizontal rolls and optionally vertical rolls and these rolls are supported on the spacer structure when the housings are displaced away from each other and from the spacer structure.

6 Claims, 2 Drawing Sheets

ROLLING MILL HOUSING STRUCTURE

This invention relates to a housing structure for a rolling mill stand and to a method of changing the rolls of such a rolling mill stand.

An object of the present invention is to provide a housing structure for a rolling mill stand which enables the pair of horizontal mill rolls and optionally a pair of vertical rolls to be readily replaced with a minimum of time delay.

According to a first aspect of the present invention, a housing structure for a rolling mill stand comprises two mill housings arranged in spaced apart side-by-side relation, said housings providing support for a pair of horizontal rolls and optionally a pair of vertical rolls, each housing being mounted for displacement in the direction towards and away from the other housing, a spacer structure capable of supporting all the rolls and means for removably securing the housings together with the spacer structure clamped between them.

In use, the rolls, whether the pair of horizontal rolls or the pair of horizontal rolls and a pair of vertical rolls, are supported in the two mill housings and are rotated in the normal manner. The workpiece is passed through the spacer structure into engagement with the rolls.

The housings are conveniently secured together with pre-stressed bolts and, by disconnecting the nuts from the bolts, the housings can be separated from the spacer structure. Conveniently each mill housing has wheels on which the housing is supported on horizontal rails.

According to a second aspect of the present invention, in a method of changing the rolls of a rolling mill stand, the rolls are supported on a spacer structure clamped between a pair of spaced apart side-by-side mill housings, the clamping means are removed to separate the spacer structure from the housings, the housings are displaced in opposite directions from the spacer structure, the spacer structure with the rolls is removed from between the housings and replaced with a spacer structure with replacement rolls and the housings are secured together with the spacer structure clamped between them.

The mill housings may each comprise a vertically disposed closed frame defining a window for receiving the bearing chock assemblies of the horizontal rolls and with a horizontal 'U'-shaped yoke projecting from the side of the frame which is away from the other housing.

A spacer structure carrying the replacement rolls and guides for guiding the workpiece is prepared and, after the spacer structure carrying the rolls to be replaced has been removed from between the mill housings, the previously prepared spacer structure with the rolls and guides is positioned between the mill housings and the housings are secured together with the spacer structure clamped between them. The bearing chock assemblies on the horizontal rolls are positioned in the windows defined by the mill housings and the drive spindles are connected to the ends of the horizontal rolls. Thus, the time taken for roll changing is reduced to a minimum.

In order that the invention may be more readily understood, it will now be described, by way of example only, with reference to the accompanying drawings, in which.

Figure 1:
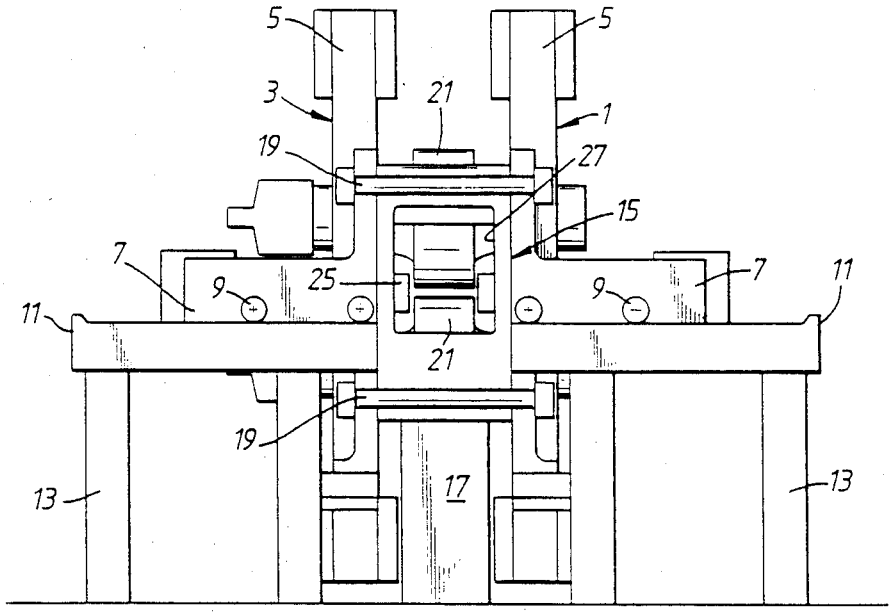
FIG. 1 is a side elevation of a rolling mill stand in accordance with the present invention.

A universal rolling mill stand which supports a pair of horizontal rolls and which can also optionally support a pair of vertical rolls is shown in the figures. The rolling mill stand can readily be converted from one which is used as a universal mill stand to one which supports only the horizontal rolls.

A pair of mill housings 1, 3 are arranged in spaced apart side-by-side relation. Each housing comprises a vertically disposed closed frame 5 which defines a conventional housing window. A pair of horizontally disposed frames 7 are secured individually to each of the vertical frames 5 on the side thereof which is away from the other frame. Each horizontal frame has a pair of parallel elongate side limbs connected together at one end by a cross piece and connected at their opposite ends to the vertical frame. Each housing is provided with wheels 9 which permit the housing to be supported and displaceable along horizontal rails 11 which are mounted on vertical supports 13. A spacer structure 15 is mounted on a table 17 and located between the housings 1, 3. The housings are secured together by way of pre-stressed bolts 19 which extend between the housings and which secure the housings together with the spacer structure 15 clamped between them.

A pair of horizontal rolls 21 are mounted with their bearing chock assemblies in the windows of the frames 5 and on one end of each roll there is a drive spindle. Each housing 5 is provided with a means (not shown) for adjusting the gap between the horizontal rolls. Each of the horizontally disposed frames 7 accommodates a vertical roll 25 supported in a bearing structure within the frame. Means (not shown) are provided for adjusting the position of the vertical rolls relative to the horizontal rolls.

In use, a workpiece to be rolled is passed through an opening 27 in the spacer structure 15 and between the rolls 21, 25. Guides are provided on the spacer structure for guiding the workpiece to be rolled.

Figure 2:
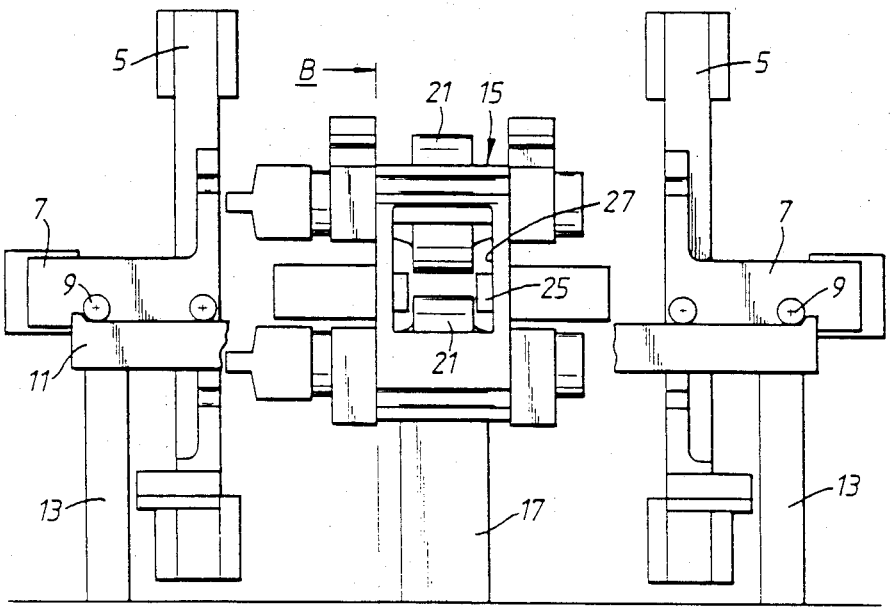
FIG. 2 is a side elevation of the stand shown in FIG. 1 with the housing separated for roll changing.
Figure 3:
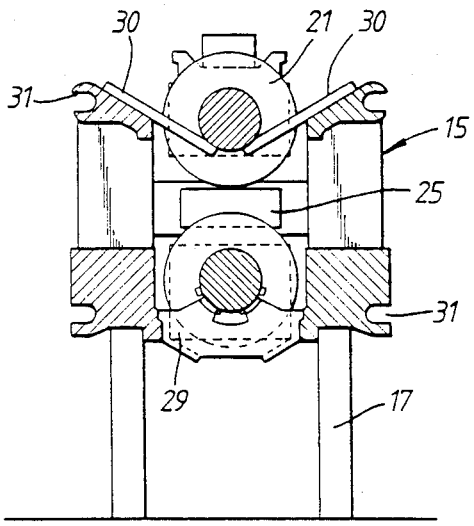
FIG. 3 is a section on the line B—B of FIG. 2.

When it is necessary to change some or all of the rolls of the rolling mill, the pre-stressed bolts 19 are released unclamping the spacer structure from the housings 1, 3. The lower work roll is lowered on to a support plate 29 forming part of the spacer structure and support plates 30 on the structure are moved inwardly to a position as shown in FIG. 3 where they support the upper work roll 21. Similarly, the vertical rolls are moved inwardly until they are supported by the spacer structure. The housings 5 are then displaced in opposite directions along the rails 11 and the bearing chock assemblies for the horizontal rolls are withdrawn from the mill housings leaving the rolls and their bearing chock assemblies supported by the spacer structure and completely separate from the mill housings. This is shown in FIG. 2 and FIG. 3.

The spacer structure and all the rolls supported on it can be lifted from the table 17 by an overhead crane and replaced with a replacement spacer with the replacement rolls already supported on it. As soon as the replacement spacer structure has been positioned on the table 17, the mill housings 5 are then displaced towards each other so that the bearing chock assemblies enter into the windows defined by the housings and the vertical rolls are contained within the 'U'-shaped yokes. Finally, the pre-stressed bolts 19 are refitted to thereby secure the housings together with the spacer structure clamped between them.

Although in the figures a universal mill having horizontal and vertical rolls is shown, the vertical rolls may be omitted so that the mill is suitable for rolling other products.

The pre-stressed bolts 19 may pass through apertures formed in the spacer structure or they may, as shown in the figures, lie in slots 31 formed in the outer walls of the spacer structure.

I claim:

1. A method of changing the rolls of a rolling mill stand in which the rolls are supported between a pair of spaced apart side-by-side mill housings with a spacer structure clamped between the housings and arranged to support the rolls during roll changing, the method comprising, removing the clamping means to separate and unclamp the spacer structure from the housings, displacing the housings in opposite directions from the spacer structure to separate the housings from the rolls so that the rolls are unsupported by the housings and supported by the spacer structure, removing the spacer structure with the rolls from between the housings, replacing said spacer structure and rolls with a spacer structure with replacement rolls between said housings, and moving said housings towards one another to supportingly retain said replacement rolls by said housings and securing the housings together with the spacer structure clamped between them with said replacement rolls being unsupported by said spacer structure.

2. A housing structure for a rolling mill stand comprising two mill housings arranged in spaced apart side-by-side relation, said housings providing support for a pair of horizontal rolls and optionally a pair of vertical rolls, each housing being mounted for displacement toward the other housings to a position where the rolls are supported by the housings and away from the other housing to a position where the rolls are unsupported by the housings, a spacer structure positioned between the housings and removable means for securing the housings together with the spacer structure clamped between them, said spacer structure being supported on means independent of the housings and said structure providing support for the rolls so that, after removal of the removable means, the housings can be displaced away from each other leaving the rolls supported on the spacer structure.

3. A housing structure as claimed in claim 2, in which the removable means for securing the housings together comprise pre-stressed bolts.

4. A housing structure as claimed in claim 2, in which each housing comprises a vertically disposed closed frame defining a window with a horizontally disposed frame secured to the vertical frame on the side thereof which is away from the other housing, said horizontally disposed frame having a pair of parallel elongate side limbs connected together at one end by a cross piece and connected at their opposite ends to the vertical housing.

5. A housing structure as claimed in claim 2, in which each mill housing has wheels on which the housing is supported on horizontal rails.

6. A housing structure as claimed in claim 2, in which the spacer structure includes guides for a workpiece to be rolled.

* * * * *